United States Patent [19]

Beaulieu

[11] Patent Number: 4,919,259

[45] Date of Patent: Apr. 24, 1990

[54] PORTABLE DISPLAY CASE

[75] Inventor: Bryan Beaulieu, Burnsville, Minn.

[73] Assignee: Skyline Displays, Inc., Burnsville, Minn.

[21] Appl. No.: 335,806

[22] Filed: Apr. 3, 1989

[51] Int. Cl.[5] ..... B65D 5/52

[52] U.S. Cl. ..... 206/45.2; 206/444; 220/339

[58] Field of Search ..... 220/339; 206/45.2, 444, 206/45.21, 45.22, 44.11, 45.28

[56] References Cited

U.S. PATENT DOCUMENTS

| | | | |
|---|---|---|---|
| 414,702 | 11/1889 | Grimm . | |
| 3,217,949 | 11/1965 | Davis | 222/480 |
| 3,458,113 | 7/1969 | Swatzbaugh | 220/239 |
| 3,469,732 | 9/1969 | Foster | 220/31 |
| 3,542,235 | 11/1970 | Hidding | 220/29 |
| 3,551,940 | 1/1971 | Edison | 220/239 |
| 3,580,650 | 5/1971 | Morris | 312/7 |
| 4,082,391 | 4/1978 | Turner | 312/314 |
| 4,254,865 | 3/1981 | Pacey et al. | 220/339 |
| 4,412,616 | 11/1983 | Williams | 206/333 |
| 4,418,819 | 12/1983 | Shapiro | 220/339 |
| 4,635,797 | 1/1987 | Bankier | 206/444 |

*Primary Examiner*—Joseph Man-Fu Moy
*Attorney, Agent, or Firm*—Paul L. Sjoquist

[57] ABSTRACT

A portable display case formed in three sections, having hinging strips interconnecting the respective sections, the hinging strips each having a center line of perforations for facilitating bending, and also having a parallel line of perforations equally spaced on either side of the center line of perforations, the distance between the parallel lines of perforations being substantially equal to the thickness of the center section of the three sections.

4 Claims, 2 Drawing Sheets

PORTABLE DISPLAY CASE

FIELD OF THE INVENTION

This invention relates generally to display cases and, more particularly, to a multisectional, portable display case which can be converted conveniently from an information transporting configuration to an information displaying configuration.

BACKGROUND OF THE INVENTION

There are many and various methods and devices for displaying and presenting visual information. Portable easel-type frames may be used to support information bearing placards or panels or such panels or placards may include integral, foldably attached supporting panels or frames. In the former example, the frames must be carried and erected independently from the material to be displayed and the latter may be cumbersome and flimsey when erected. In addition, in both examples the material to be displayed must be afforded protection while being transported, generally requiring a portable container of some sort.

Portable containers or cabinets, including portable or collapsible cabinets, are known. U.S. Pat. No. 3,580,650 (to Morris) discloses a portable cabinet structure of molded plastic for housing electronic equipment. The cabinet includes box-shaped casing members connected by integral hinging strips so that the casing members are foldable about the hinging strips into operational configuration. The cabinet structure is molded from a thermoplastic material having sufficient flexibility for the hinging section and rigidity for the box-shaped section. The hinging strips are of reduced cross-sectional area compared to the walls of the sections, but do not have a feature that enables them to fold or collapse onto themselves and thereby occupy a minimal space between the casing sections.

DISCLOSURE OF THE INVENTION

It is a general object of the present invention to provide a multisectional portable display case for both transporting and displaying material.

Another object of the present invention is to provide an improved portable display case that may be conveniently converted from a slim, compact transporting mode to a point-of-use, free-standing display mode.

A specific object of the present invention is to provide a multisectional display case having a plurality of sections that are connected by flexible hinges so that the sections may be folded at the hinges to form a carrying case and unfolded at the hinges to form a display case.

These and other objects of the present invention are achieved by providing an improved portable display case having a number of sections connected at their lateral edges by flexible hinges so that the sections may be folded at the hinges into close parallel proximity to one another to form a compact carrying case and unfolded into a generally planar, free-standing display configuration in which the hinges permit the sections to become opened even beyond 180°, to provide a versatile display.

Other objects and advantages of the present invention will be understood with reference to the following specification and appended drawings and claims.

DESCRIPTION OF THE PREFERRED EMBODIMENT

Figure 1:
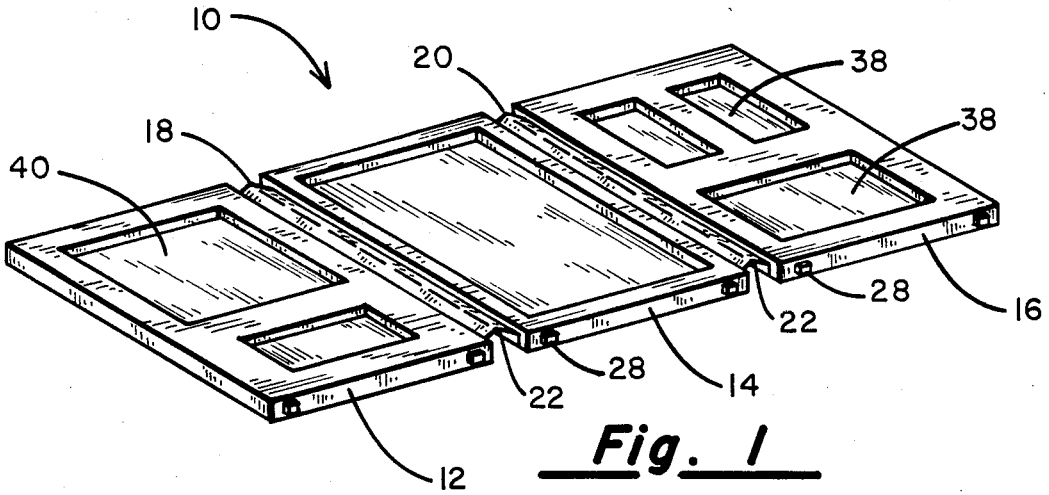
FIG. 1 is a perspective view of the display case of the present invention unfolded in a flat display mode.

With reference to the figures, it will be noted that the portable display case of the present invention, designated generally as 10, includes three sections: section 12, central section 14 and section 16. The sections are generally rectangular with lateral sidewalls and have a shallow box- or tray-like shape. The sections may be molded from any sufficiently rigid thermoplastic material.

Sections 12 and 14 and sections 14 and 16 are joined at their adjacent lateral sidewalls or edges by hinges 18 and 20 respectively. The hinges are flexible, or "living," hinges and may be attached to the section sidewalls by any suitable conventional means such as by riveting, by adhesive means or by both. Three lines of weakness 22 are provided on each hinge, which are of identical construction. The lines of weakness are spaced from one another, are parallel and extended for the length of the hinges. Any suitable material may be used to form the hinges as long as it is flexible yet strong enough to withstand repeated flexures. The lines of weakness may be formed during the thermoforming process of making the hinges (if a thermoplastic material is used), by scoring or by spaced-apart perforations. As will be seen from the discussion of the operation of the display case, the lines of weakness enable the hinges to expand or collapse so that the display case may assume its carrying mode position or its display mode or open position, and so that the same hinge construction may be used along either the section 12/14 interface or the section 14/16 interface.

Figure 2:
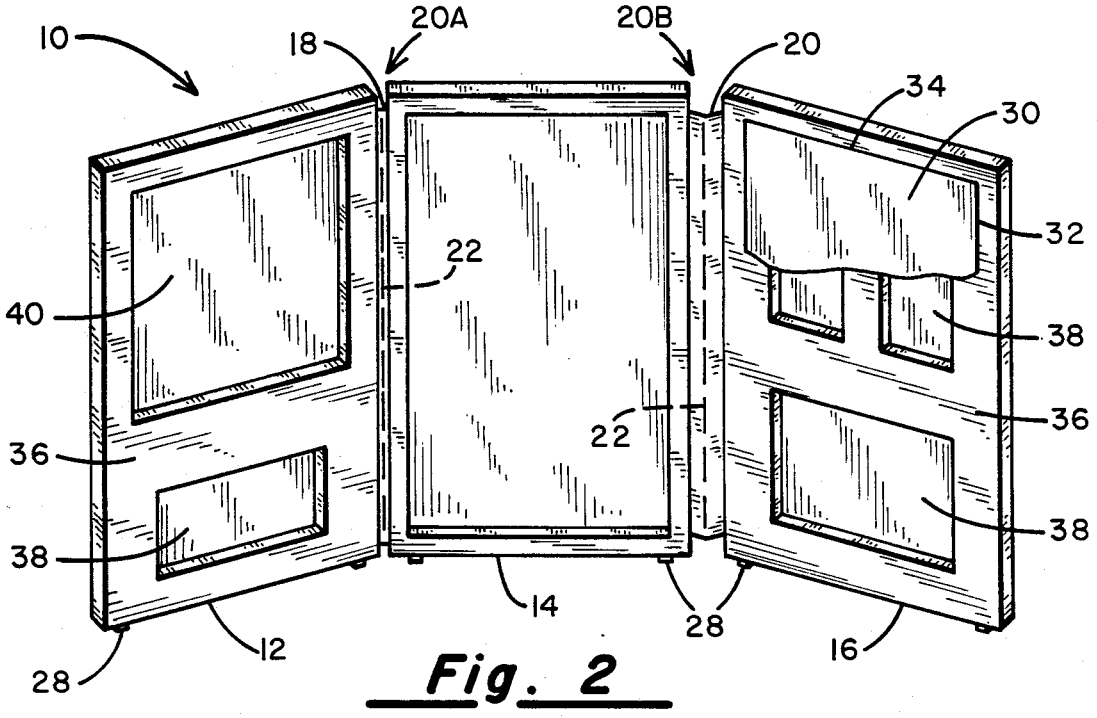
FIG. 2 is a perspective front view of the display case of FIG. 1 in its free-standing, erect display mode.

With further reference to the figures, a handle 24 is provided for use when the display case is in its carrying mode. The handle is positioned on the inner edge of section 12, so that when the case is in its display mode, as shown in FIG. 2, it cannot be seen. Securing straps 26 are provided for securing the display case in its carrying mode, but it is not beyond the scope of the present invention that a snap closure device be provided between the sections. Support feet 28 may be attached to the lateral end walls of the sections to provide non-slip support while the display case is in its upright display mode.

In FIG. 2, a broken section shows a portion of the interior 30 of a section 16. Display panel supports 36 molded integrally with the section extend around the interior periphery of the section. Velcro-type material 34 may be used to secure interchangeable and various display panels 32 in place, but the panels may also be held in place by any means such as snap or adhesive means. The panels may be of any desired configuration having (as shown) apertures 38 for receiving information material and placards 40. Additionally, it is not beyond the scope of the present invention that an energy-powered display light, sound or motion may be used in the display case, and may be placed in any aperture. As one example of such an application a light source may be positioned inside an aperture 38 and a translucent image may be affixed over the aperture 38 to provide a back-lighted display.

Figure 3:
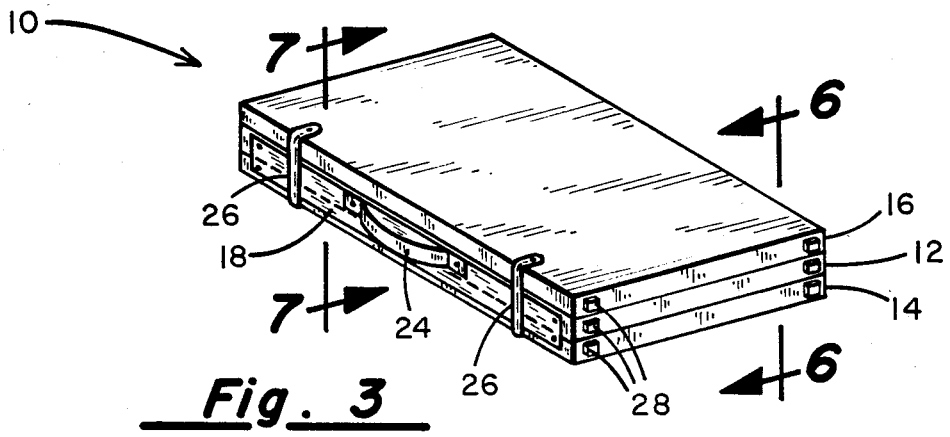
FIG. 3 is a perspective view of the display case of the present invention folded into its carrying mode.
Figure 4:
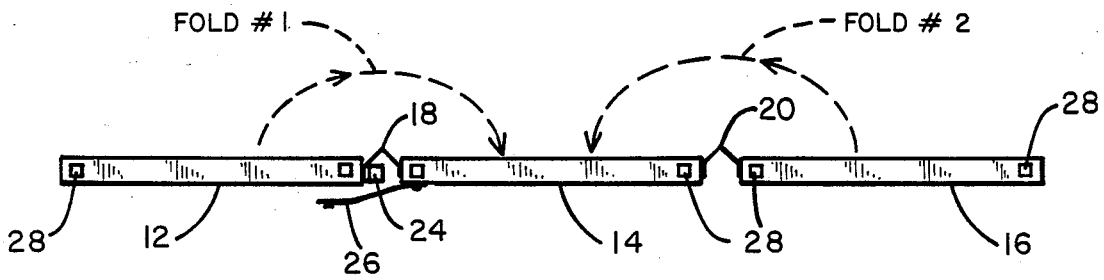
FIGS. 4 and 5 are end views of the display case shown in FIGS. 1 to 3, including phantom lines illustrating the folding of the display case from its configuration in FIG. 2 to its configuration depicted in FIG. 3.
Figure 5:
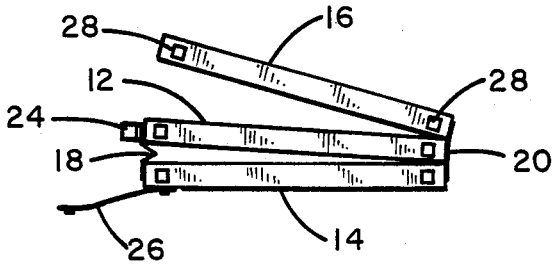

The operation and use of the display case of the present invention can be seen and understood by reference to FIGS. 2 through 5. In FIG. 2, the case is depicted in a display mode. FIGS. 4 and 5 depict the operational transition to the carrying mode shown in FIG. 3. The purpose and function of the hinge lines of weakness should be noted. In FIG. 2, at 20A, the lines of weakness enable the hinge 18 to collapse upon itself to occupy a minimal space between adjacent panels 12 and 14, thus enabling the display to have a unified, pleasing appearance. The other hinge 20 is shown expanded at 20B to illustrate function, but of course, will attain the hinge configuration shown at 20A. FIG. 5 shows that the hinges may expand as at 20 to allow the case to be closed into the carrying mode shown in FIG. 3. It will be appreciated that the flexibility of the hinges 18, 20 and the hinge lines of weakness combine to permit either a display of only one section interior, or a sequential display of section interiors, or a generally planar display of all section interiors, as well as display of the section interiors at any angle relative to one another, or complete closure of the display case into its portable or carrying mode.

Figure 6:
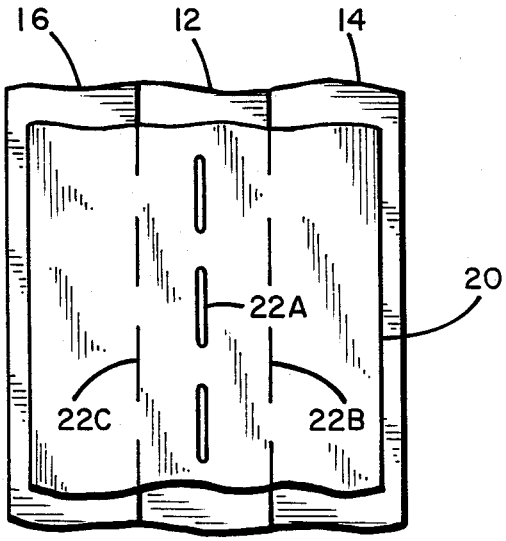
FIG. 6 is an expanded view of a hinge section.
Figure 7:
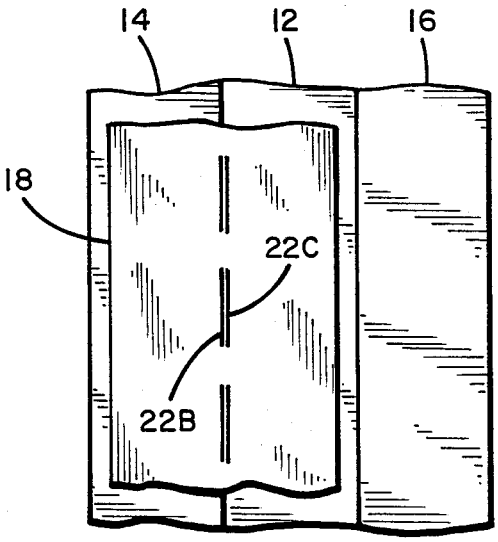
FIG. 7 is a further expanded view of a hinge section.

FIG. 6 illustrates an expanded view of a portion of hinge 20, viewed from the direction 6—6 of FIG. 3. A central sequence of elongated perforations 22A is proximately centered along the edge of section 12. Parallel lines of weakness are formed along hinge line 22B and hinge line 22C, and these parallel lines of weakness may similarly be formed by a sequence of perforations. Hinge lines 22B and 22C are approximately in alignment with the respective alignment edges 12/14 and 14/16. FIG. 7 shows an expanded view of a portion of hinge 20, viewed along the direction 7—7 of FIG. 3. In this case, hinge 18 is affixed along one edge to section 14 and along the other edge to section 12, and perforated hinge line 22A is contained between sections 14 and 16. Hinged lines 22B and 22C are effectively adjacent one another, to permit a full closure of sections 12, 14 and 16. When the display case 10 is opened to a flat position as shown in FIG. 4, it is apparent that hinge 18 permits sufficient flexibility so as to place sections 12 and 14 either immediately adjacent one another, or in a spaced-apart relationship. Similarly, hinge 20 permits sections 14 and 16 to be positioned adjacent one another or in a spaced-apart configuration. It is also apparent that the flexibility of hinges 18 and 20 will permit sections 12 and 16 to become opened beyond 180° to provide an upright display which may be viewed from both sides and from the front. When the display case 10 of FIG. 4 is closed, first section 12 is folded over to align atop section 14, and then section 16 is folded over to align atop section 12, as shown in FIG. 4 and FIG. 5. All the foregoing positions and options may be achieved by the use of a single hinge material construction, which may be manufactured in web form and cut to size to fit particular display cases 10.

From the preceding description it will be appreciated that the portable display case of the present invention provides for both the convenient, safe transportation of display material and the attractive, convenient presentation of that material.

The present invention may be embodied in other specific forms without departing from the spirit or essential attributes thereof, and it is therefore desired that the present embodiment be considered in all respects as illustrative and not restrictive, reference being made to the appended claims rather than to the foregoing description to indicate the scope of the invention.

What is claimed is:

1. A portable multisectional display case for displaying and transporting information, said case comprising:

a center section having a planar front surface and a first lateral sidewall and a second lateral sidewall;

at least two adjacent sections having planar front surfaces and lateral sidewalls;

a first hinge means connecting said first lateral sidewall of said center section to a lateral sidewall of one of said adjacent sections and a second hinge means connecting said second lateral sidewall of said center section to a lateral sidewall of another adjacent section;

both of said hinge means being formed from a web material having a center line of weakness formed by a series of spaced-apart perforations, and having a parallel line of weakness equally spaced on either side of said center line of weakness, the distance between said parallel lines of weakness being substantially equal to the thickness of said center section lateral sidewall;

said adjacent sections being foldable about said hinge means from a carrying position wherein said two adjacent sections are folded to overlie said center section, and being unfoldable about said hinge means to form a display position wherein said two adjacent sections form a display surface in combination with said center section.

2. The display case defined in claim 1, wherein said hinge means is flexible about all of said lines of weakness.

3. The display case defined in claim 1, wherein said display case includes a handle means for carrying said case, affixed to one of said lateral sidewalls.

4. The display case defined in claim 2, wherein said display case includes securing means for securing the outermost of said sections to one another when said sections are folded into a carrying position.

* * * * *